US010385867B2

(12) United States Patent
Song

(10) Patent No.: US 10,385,867 B2
(45) Date of Patent: Aug. 20, 2019

(54) MULTI-DIRECTIONAL COOLING FAN

(71) Applicant: Jinhua City Xin'an Electric Co., Ltd, Jinhua (CN)

(72) Inventor: Binglu Song, Jinhua (CN)

(73) Assignee: Jinhua City Xin'an Electric Co., Ltd., Jinhua (CN)

( * ) Notice: Subject to any disclaimer, the term of this patent is extended or adjusted under 35 U.S.C. 154(b) by 201 days.

(21) Appl. No.: 15/654,509

(22) Filed: Jul. 19, 2017

(65) Prior Publication Data

US 2018/0023590 A1 Jan. 25, 2018

(30) Foreign Application Priority Data

Jul. 19, 2016 (CN) ..... 2016 2 0756846 U

(51) Int. Cl.

| | |
|---|---|
| ***F04D 29/46*** | (2006.01) |
| ***B01F 3/04*** | (2006.01) |
| ***B05B 7/00*** | (2006.01) |
| ***F24F 6/16*** | (2006.01) |
| ***F04D 29/42*** | (2006.01) |

(Continued)

(52) U.S. Cl.

CPC ..... *F04D 29/462* (2013.01); *B01F 3/04021* (2013.01); *B05B 7/0081* (2013.01); *F04D 29/4246* (2013.01); *F04D 29/705* (2013.01); *F24F 6/12* (2013.01); *F24F 6/16* (2013.01); *B05B 7/0012* (2013.01); *B05B 17/0669* (2013.01); *F04D 17/04* (2013.01); *F04D 25/105* (2013.01)

(58) Field of Classification Search

CPC . B01F 3/04021; B05B 7/0081; B05B 7/0012; B05B 17/0669; F04D 29/462; F04D 29/4246; F04D 29/705; F04D 17/04; F04D 25/105; F24F 6/12; F24F 6/16

USPC ..... 261/28, 81, DIG. 3, DIG. 43

See application file for complete search history.

(56) References Cited

U.S. PATENT DOCUMENTS 2,856,700 A * 10/1958 Wales ..... A45D 20/08 34/622

3,469,785 A 9/1969 Boucher et al.

(Continued)

FOREIGN PATENT DOCUMENTS

| | | |
|---|---|---|
| GB | 1094101 | 12/1967 |
| WO | 2014/036907 | 3/2014 |

(Continued)

*Primary Examiner* — Charles S Bushey

(74) *Attorney, Agent, or Firm* — David L. Stott

(57) ABSTRACT

A cooling fan extending vertically to define a longitudinal axis, the cooling fan configured to blow air and mist therefrom. The cooling fan includes a base and multiple stacked duct housings with a fan housing therebetween, each of the duct housing being rotatably coupled to each other. The base includes a water tank associated with an atomizer, an axial flow fan, and a misting tube, the misting tube extending upward from the atomizer along the axis through an air duct defined by the duct housings. Each of the duct housings include an air outlet and a misting outlet to independently disperse air and mist therefrom to be mixed upon exiting the cooling fan. With this arrangement, each one of the duct housings is rotatable about the longitudinal axis relative to an adjacent one of the multiple duct housings to provide directional misted air flow from multiple selected positions.

16 Claims, 8 Drawing Sheets

(51) Int. Cl.

| | |
|---|---|
| ***F04D 29/70*** | (2006.01) |
| ***F24F 6/12*** | (2006.01) |
| *F04D 17/04* | (2006.01) |
| *F04D 25/10* | (2006.01) |
| *B05B 17/06* | (2006.01) |

(56) References Cited

U.S. PATENT DOCUMENTS

| | | | | |
|---|---|---|---|---|
| 4,087,495 | A | 5/1978 | Umehara | |
| 4,520,864 | A | 6/1985 | Katagiri et al. | |
| 4,642,441 | A | 2/1987 | Kenyon | |
| 4,737,173 | A | 4/1988 | Kudirka et al. | |
| 4,743,739 | A | 5/1988 | Tateishi | |
| 4,746,466 | A | 5/1988 | Takahashi | |
| 5,660,586 | A | 8/1997 | Chiu et al. | |
| 5,693,266 | A | 12/1997 | Jung | |
| 6,293,121 | B1 | 9/2001 | Labrador | |
| 6,321,034 | B2 * | 11/2001 | Jones-Lawlor | F04D 25/105 392/367 |
| 6,830,433 | B2 * | 12/2004 | Birdsell | F04D 25/166 416/110 |
| 6,842,581 | B2 * | 1/2005 | Schafer | A47K 10/48 34/90 |
| 7,047,761 | B2 | 5/2006 | Hwang et al. | |
| 7,059,826 | B2 * | 6/2006 | Lasko | F04D 25/166 415/127 |
| 7,156,616 | B2 * | 1/2007 | Lee | F04D 25/166 415/127 |
| 7,158,716 | B2 | 1/2007 | Shapiro et al. | |
| 7,231,777 | B1 | 6/2007 | Arnold et al. | |
| 7,337,626 | B2 | 3/2008 | Lee | |
| 7,362,964 | B2 * | 4/2008 | Wang | F24F 6/00 261/104 |
| D778,417 | S * | 2/2017 | Bu | D23/351 |
| 9,745,981 | B2 | 8/2017 | Dos Reis et al. | |
| 9,797,414 | B2 | 10/2017 | Hodgson et al. | |
| 2004/0108604 | A1 | 6/2004 | Pan et al. | |
| 2004/0120700 | A1 | 6/2004 | Orr et al. | |
| 2005/0086963 | A1 | 4/2005 | Lee | |
| 2005/0123392 | A1 * | 6/2005 | Belsito | F04D 17/04 415/53.1 |
| 2006/0037355 | A1 | 2/2006 | Hwang et al. | |
| 2006/0182429 | A1 | 8/2006 | Shapiro et al. | |
| 2006/0264166 | A1 | 11/2006 | Ngan | |
| 2007/0077042 | A1 | 4/2007 | Jayaram et al. | |
| 2007/0129001 | A1 | 6/2007 | Orr | |
| 2009/0014556 | A1 | 1/2009 | Gokal | |
| 2009/0120925 | A1 | 5/2009 | Lasko | |
| 2009/0229289 | A1 | 9/2009 | Ohmae et al. | |
| 2009/0317240 | A1 * | 12/2009 | Wei | F04D 25/105 415/127 |
| 2011/0162528 | A1 | 7/2011 | Yamagushi et al. | |
| 2013/0153173 | A1 | 6/2013 | Nakamura | |
| 2014/0147297 | A1 | 5/2014 | Iyer et al. | |
| 2014/0306636 | A1 | 10/2014 | Yu | |
| 2015/0241072 | A1 | 8/2015 | Kim | |
| 2015/0285516 | A1 | 10/2015 | Hanks et al. | |
| 2016/0209055 | A1 | 7/2016 | Gedcke et al. | |
| 2016/0252260 | A1 | 9/2016 | Jewell et al. | |
| 2016/0363366 | A1 | 12/2016 | Angle et al. | |
| 2017/0138620 | A1 | 5/2017 | Wang et al. | |
| 2017/0138622 | A1 | 5/2017 | Wang et al. | |
| 2017/0276380 | A1 | 9/2017 | Sakikawa et al. | |
| 2017/0304861 | A1 | 10/2017 | Seo | |
| 2017/0354988 | A1 | 12/2017 | Ohidou et al. | |

FOREIGN PATENT DOCUMENTS

| | | |
|---|---|---|
| WO | 2015/025539 | 2/2015 |
| WO | 2015/145465 | 10/2015 |

* cited by examiner

MULTI-DIRECTIONAL COOLING FAN

CROSS-REFERENCE TO RELATED APPLICATION

The present application claims priority to Chinese Patent Application No. 201620756846.2, filed on Jul. 19, 2016, entitled TORNADO AIR COOLER, the disclosure of which is incorporated herein in its entirety by reference.

TECHNICAL FIELD

The present invention relates to fans and, more specifically, the present invention relates to a multi-directional cooling fan.

BACKGROUND

The typical electrical fan on the market blows in a single direction with a single air outlet. Further, such electrical fans typically provide a limited area through which air is dispersed or blown and typically blow at a single speed. Further, although typical fans may cause air movement within a given room, such fans typically don't lower the room temperature in the room and can cause additional dust particles to be swept into the air. As a result, typical electric fans do little to improve the comfort level within a given room.

BRIEF SUMMARY OF THE INVENTION

The present invention is directed to various embodiments of a cooling fan. For example, the cooling fan may extend vertically to define a longitudinal axis and may be configured to blow air and mist therefrom. In accordance with one embodiment, the cooling fan includes a base, a fan housing, and first, second and third duct housings. The base includes a tank sized and configured to hold water, the tank including a misting tube, an atomizer, and an axial flow fan associated therewith. The fan housing is rotatably coupled to the base, the fan housing defining an air inlet therein and including a fan coupled to the fan housing. The fan housing defines a base duct adjacent to the fan configured to facilitate upward air flow. The first duct housing is coupled to the fan housing so as to facilitate the air flow from the base duct. The first duct housing is positioned above the fan housing and includes a first air outlet and a first misting outlet. The first air outlet communicates with the air flow flowing from the base duct and the first misting outlet communicates with the misting tube. The second duct housing is rotatably coupled to the first duct housing so as to facilitate the air flow from the first duct housing. The second duct housing is positioned above the first duct housing and includes a second air outlet and a second misting outlet. The second air outlet communicates with the air flow flowing from the base duct and the second misting outlet communicates with the misting tube. The third duct housing is rotatably coupled to the second duct housing so as to facilitate the air flow from the second duct housing. The third duct housing is positioned above the second duct housing and includes a third air outlet and a third misting outlet. The third air outlet communicates with the air flow flowing from the base duct and the third misting outlet communicates with the misting tube. Further, the cooling fan includes a cover housing coupled to an upper portion of the third duct housing. Such cover housing includes a circuit control board coupled thereto with input controls associated therewith.

In another embodiment, the fan housing with each of the first, second and third duct housings coupled thereto is configured to oscillate about the longitudinal axis relative to the base. In still another embodiment, the fan housing is configured to oscillate about the longitudinal axis relative to the base with a range of oscillation between about 10 degrees and about 180 degrees.

In another embodiment, the second duct housing is rotatable about the longitudinal axis relative to the first duct housing such that the second air outlet and second misting outlet is positionable in a non-aligned manner relative to the first air outlet and the first misting outlet. In yet another embodiment, the second duct housing is rotatable about the longitudinal axis relative to the first duct housing with a range of rotation of up to about 240 degrees. In still another embodiment, the third duct housing is rotatable about the longitudinal axis relative to the second duct housing with a range of rotation of up to about 240 degrees.

In another embodiment, the misting tube includes a lower misting tube and multiple upper misting tubes, the lower misting tube extending between the water tank and a lower most one of the upper misting tubes, each of the upper misting tubes coupled together and extending longitudinally along the longitudinal axis such that the upper misting tubes collectively form a column that extends through the first, second and third duct housings. In still another embodiment, the air flow from the first, second, and third air outlets draws mist outward from the respective first, second, and third misting outlets to mix therewith and disperse outward. In yet another embodiment, the atomizer is configured to produce ultrasonic frequencies to generate the mist, the ultrasonic frequencies produced by the atomizer are in the range of 1.0 MHz to 1.7 MHz.

In accordance with another embodiment of the present invention, a cooling fan extends vertically to define a longitudinal axis and is configured to blow air and mist therefrom. The cooling fan includes a base, a fan housing, and multiple duct housings. The base includes a tank sized and configured to hold water, the tank including a misting tube, an atomizer, and an axial flow fan associated therewith. The atomizer is configured to generate the mist such that the axial flow fan directs the mist upward through the misting tube. The fan housing is rotatably coupled to the base, the fan housing defining an air inlet therein and including a fan coupled to the fan housing. The fan housing defines a base duct adjacent to the fan configured to facilitate upward air flow. The multiple duct housings are coupled in an upward stacked arrangement to form an air duct communicating with the base duct, each of the multiple duct housings including an air outlet and a misting outlet. The air outlet communicates with the air flow from the base duct and the misting outlet communicates with the misting tube. With this arrangement, each one of the multiple duct housings is rotatable about the longitudinal axis relative to an adjacent one of the multiple duct housings in the range of up to about 240 degrees.

In another embodiment, the air flow dispersing from the air outlet of each of the multiple duct housings is configured to draw mist outward from the misting outlet of each of the multiple duct housings to mix therewith and disperse outward from the multiple duct housings. In still another embodiment, each of the multiple duct housings define an outer housing portion and an inner housing portion, the inner housing portion having a tubular shape extending horizontally to define a rear side opening and a front side opening to define a through hole. In another embodiment, each of the multiple duct housings define an outer housing portion and an inner housing portion, the air outlet defined between the outer housing portion and the inner housing portion on a front side of each of the multiple duct housings.

In another embodiment, each of the multiple duct housings include the misting tube extending vertically therein, the misting tube including the misting outlets corresponding with each of the multiple duct housings. In yet another embodiment, the misting tube includes a lower misting tube and multiple upper misting tubes, the lower misting tube extending between the water tank and a lower most one of the upper misting tubes, each of the upper misting tubes coupled together and extending longitudinally along the longitudinal axis such that the upper misting tubes collectively form a column that extends through the multiple duct housings, the column of the upper misting tubes having transversely extending misting extensions corresponding with each of the multiple duct housings, the misting extensions configured to funnel the mist toward the misting outlet. In another embodiment, the atomizer is configured to produce ultrasonic frequencies to generate the mist, the ultrasonic frequencies produced by the atomizer are in the range of 1.0 MHz to 1.7 MHz.

The cooling fan of the present invention disperses air from multiple locations in multiple directions and, further, may oscillate so that air is stirred and moved over entire regions including within the range of 360 degrees about the longitudinal axis of the cooling fan. Further, the cooling fan provides misting, which remains independent until exiting to maintain the quality of the misting, which reduces the room temperature and adjusts the room humidity. The dispersed misted air can absorbe dust, particles and other harmful substances in the room, thereby, improving air quality.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
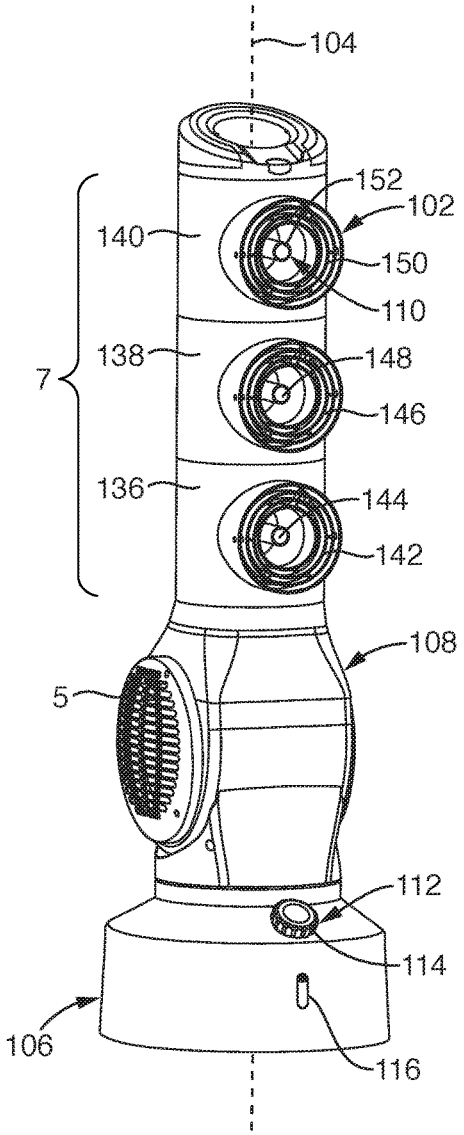
FIG. 1 is a perspective view of a cooling fan, depicting multiple air outlets in a front side position, according to an embodiment of the present invention.
Figure 2:
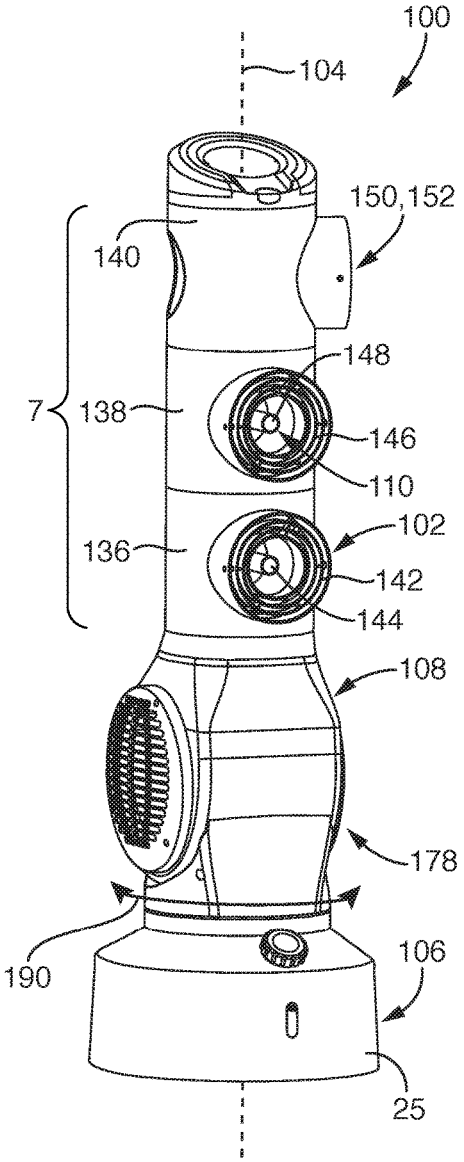
FIG. 2 is a perspective view of the cooling fan, depicting one of the multiple air outlets in an off-set position relative to the front side position, according to another embodiment of the present invention.

Referring to FIGS. 1 and 2, a cooling fan 100 having multiple air outlets 102 that may be positionably adjusted along a radius relative to each other to disperse air flow in a multi-directional manner is provided. The cooling fan 100 may exhibit a tower-like structure such that the cooling fan 100 may be elongated so as to extend vertically and define a longitudinal axis 104. Such cooling fan 100 may include a base 106, a fan housing 108, and multiple duct housings 7 coupled in an upward stacked arrangement. In one embodiment, each one of the duct housings 7 may include an air outlet 102 and a misting outlet 110 associated therewith so that the air blown from the air outlets 102 may also provide misting or water droplets in the air dispersed from the cooling fan 100. Such misting outlet 110 may independently provide the mist in a separate manner from the air dispersed from the air outlet 102 while within the cooling fan 100. Further, such mist may be drawn or pulled by the blown air and, upon the mist exiting the cooling fan 100, the mist immediately mixes with the blown air and disperses within a given room with the blown air.

In another embodiment, the misting function of the cooling fan 100 may be turned-off so that the cooling fan 100 only disperses air therefrom. In another embodiment, the cooling fan 100 may not include a misting function such that the cooling fan 100 includes the multiple air outlets 102 that may be positionably adjusted relative to each other.

Figure 3:
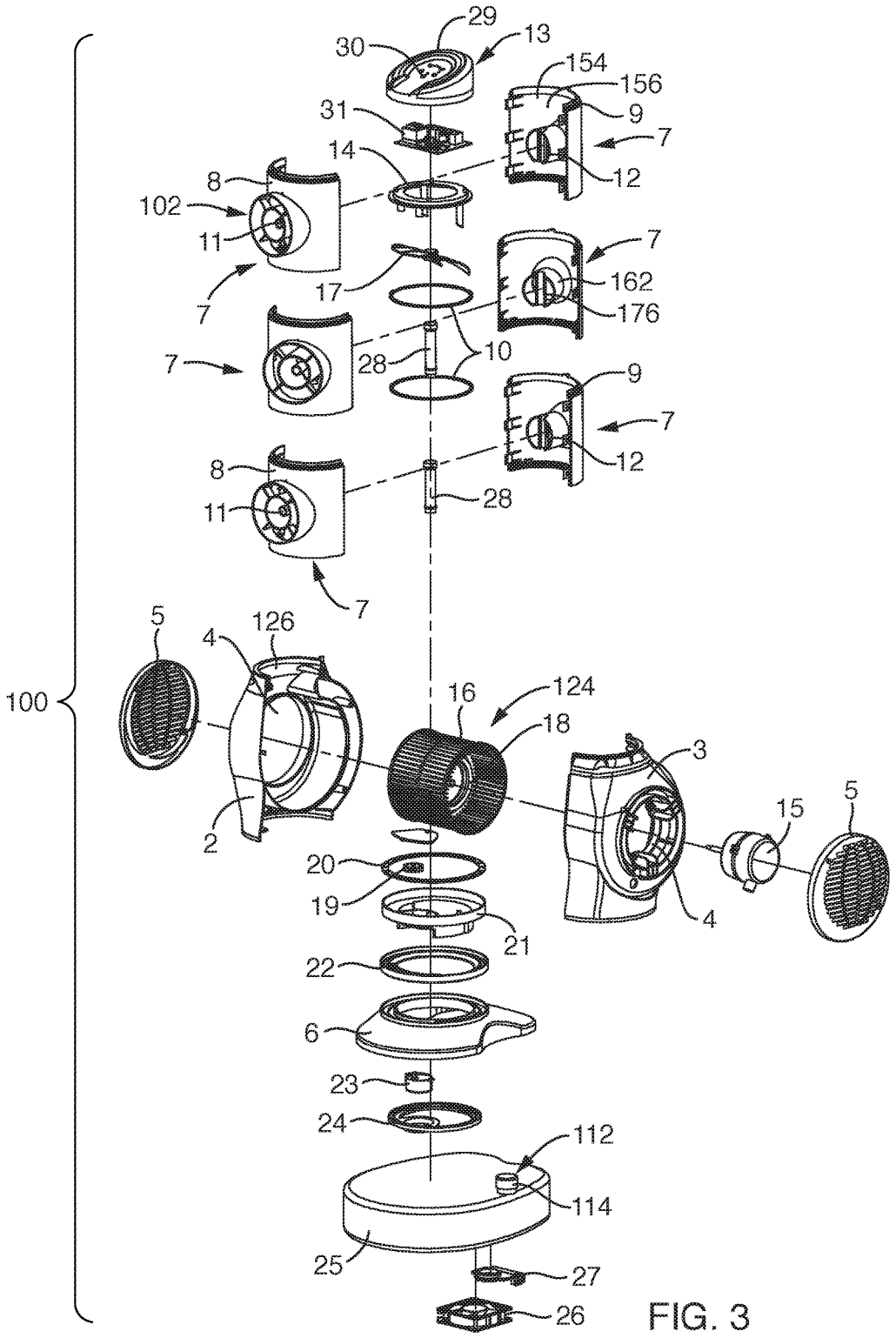
FIG. 3 is an exploded view of the cooling fan of FIG. 1, according to another embodiment of the present invention.
Figure 6:
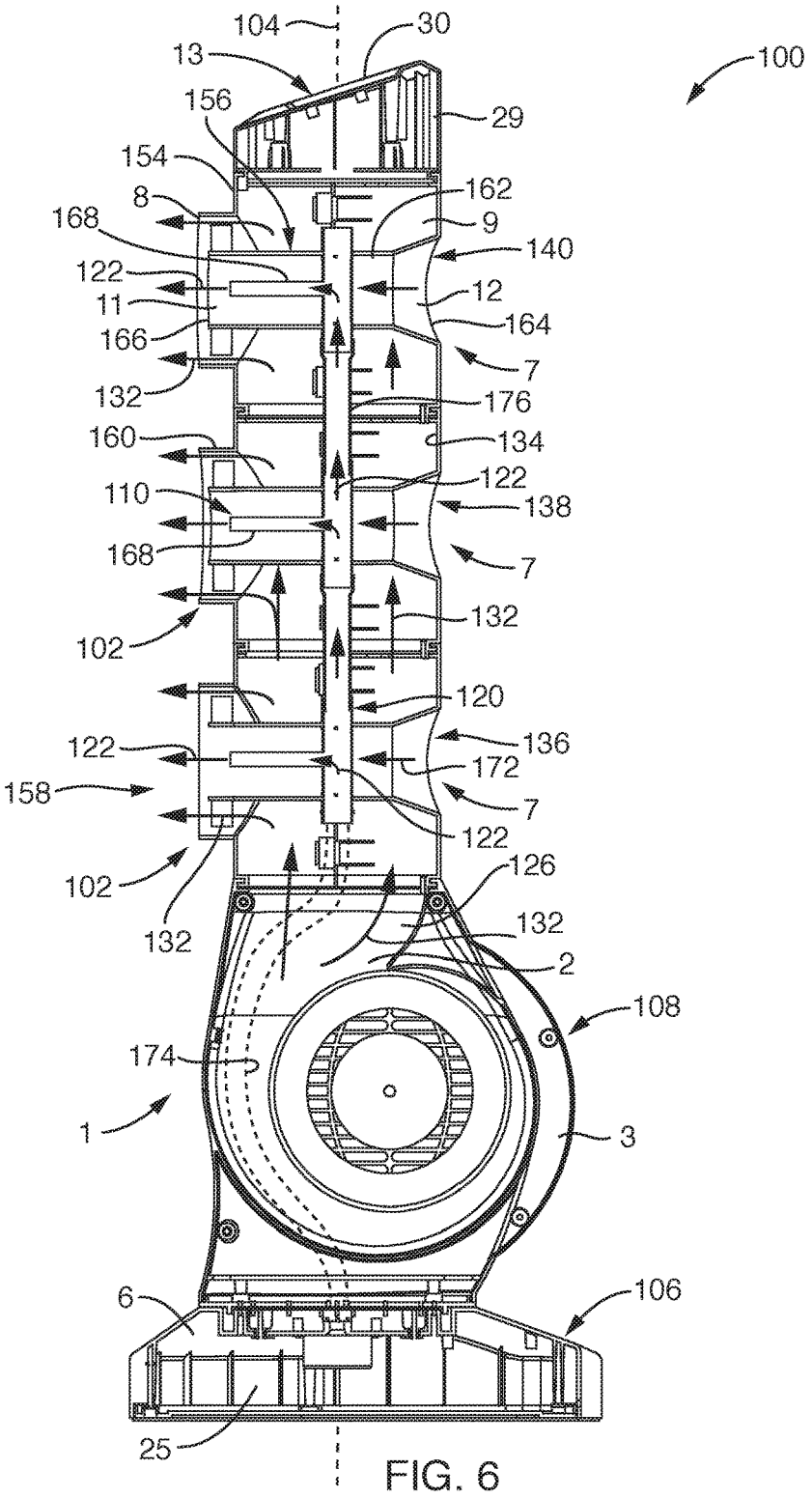
FIG. 6 is a cross-sectional view of the cooling fan taken along section A-A of FIG. 1, according to another embodiment of the present invention.
Figure 7:
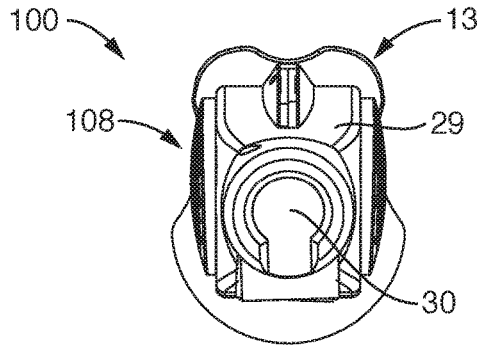
FIG. 7 is a top view of the cooling fan, according to another embodiment of the present invention.
Figure 8:
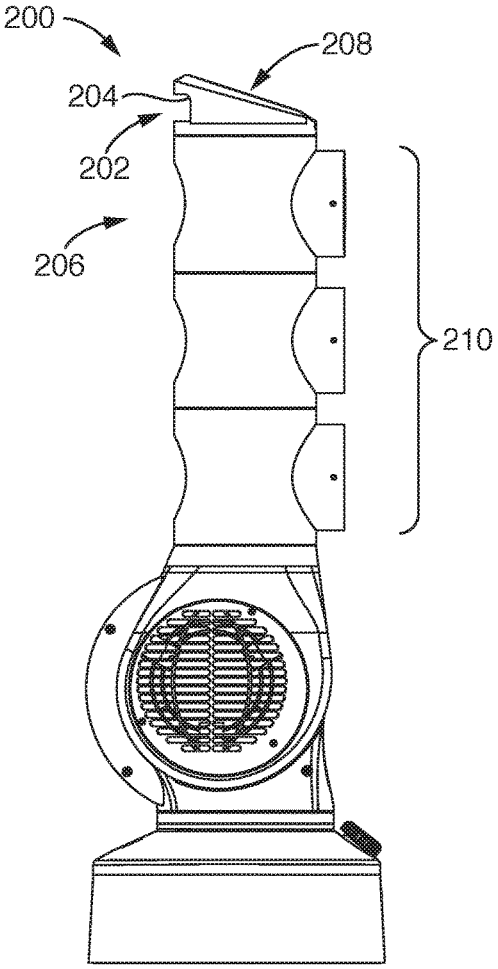
FIG. 8 is a left-side view of another embodiment of a cooling fan, depicting the cooling fan having a handle defined in a top cover portion of the cooling fan, according to the present invention.
Figure 9:
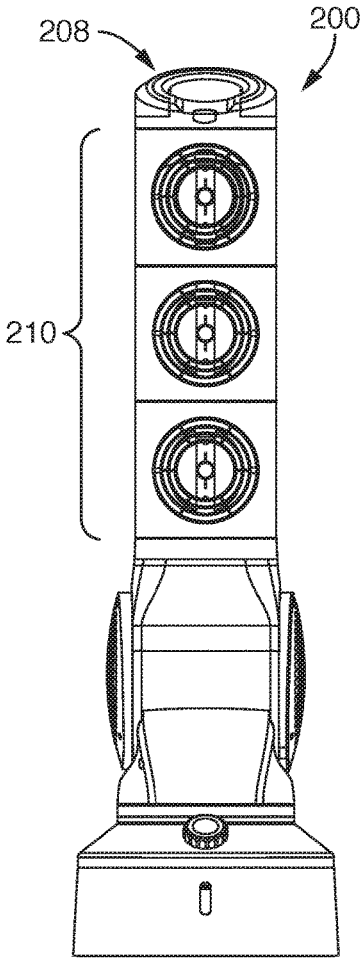
FIG. 9 is a front view of the cooling fan of FIG. 8, according to the present invention.
Figure 10:
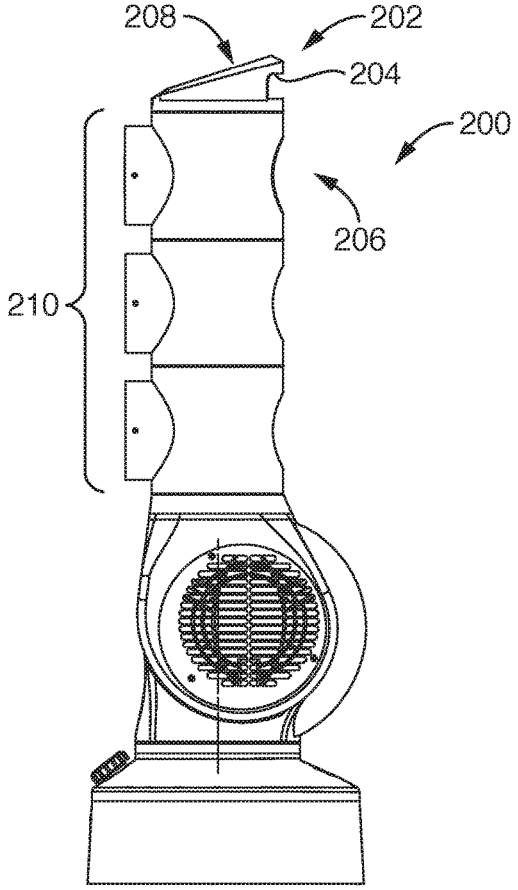
FIG. 10 is a right-side view of the cooling fan of FIG. 8, according to the present invention.
Figure 11:
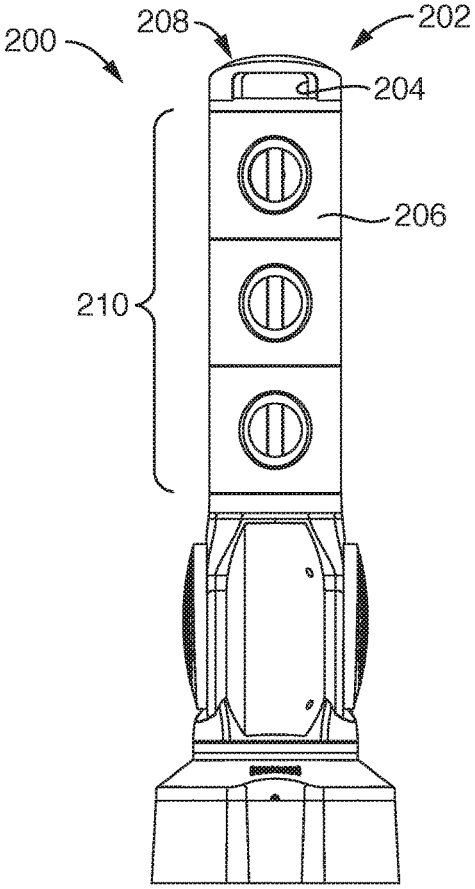
FIG. 11 a rear view of the cooling fan of FIG. 8, according to the present invention.
Figure 12:
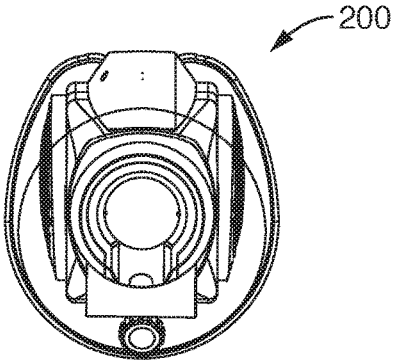
FIG. 12 is a top view of the cooling fan of FIG. 8, according to the present invention.
Figure 13:
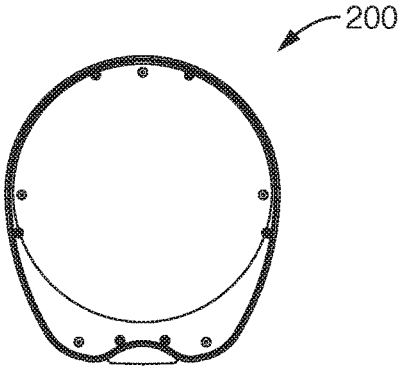
FIG. 13 is a bottom view of the cooling fan of FIG. 8, according to the present invention.

With reference to FIGS. 1, 3 and 6, as previously set forth, the cooling fan 100 may include the base 106, the fan housing 108, and the multiple duct housings 7, each of the multiple duct housings 7 having the air outlet 102 and the misting outlet 110 associated therewith. For example, the base 106 may include a tank 25 sized and configured to hold water. The base 106 may include a water-filling port 112 having a cap 114 positioned thereon. Such water-filling port 112 may be sized and configured to facilitate a user to readily pour water into the tank 25. The base 106 may also include a transparent window 116 or water level indicator so that a user may readily view a level of the water within the tank 25. Furthermore, the base 106 may include, among other elements discussed further herein, a misting tube 120, an atomizer 27, and an axial flow fan 26 associated with the base and water within the tank 25 to provide a misting function to the cooling fan 100. For example, as known to one of ordinary skill in the art, the atomizer 27 may be positioned adjacent the tank 25 so as to generate a mist such that the axial flow fan 26 can direct the mist upward, as shown with arrow 122 (FIG. 6) through the misting tube 120.

The fan housing 108 may be coupled to the base 106. In one embodiment, the fan housing 108 may be rotatably coupled to the base 106 such that the fan housing 108, along with the multiple stacked duct housings 7, may oscillate back-and-forth about the longitudinal axis 104 and relative to the base 106 within various user selected ranges. Further, such coupling of the fan housing 108 to the base 106 may include various structural components and gears and may be controlled with user input controls, as known to one of ordinary skill in the art, and discussed further herein.

The fan housing 108 may also include and house a fan 124 with an impeller 16 and a motor 15 coupled thereto sized and configured to generate upward air flow, as shown by arrow 132 (FIG. 6), along a base air duct 126. Such fan housing 108 may also include two air inlet openings or holes 4 defined therein and positioned on opposite sides of the fan 124 and fan housing 108. Such holes 4 may include air duct inlet grids 5 coupled over the holes 4 and to the fan housing 108.

As previously set forth, the multiple duct housings 7 may be coupled in an upward stacked arrangement to form a vertically extending air duct 134 communicating with the base air duct 126 such that each of the multiple duct housings 7 may include the air outlet 102 and the misting outlet 110. Each of the air outlets 102 may communicate with the air duct 134 such that the air may flow from the base duct 126, through the air duct 134 and out the air outlets 102. Each of the misting outlets 110 may communicate with the misting tube 120 such that mist may flow through the misting tube 120 and out the misting outlets 110. In one embodiment, the multiple stacked duct housings 7 may include three duct housings, for example, a first duct housing 136, a second duct housing 138, and a third duct housing 140. In another embodiment, the multiple duct housings 7 may include two duct housings or at least two duct housings. In another embodiment, the multiple duct housings 7 may include four duct housings or more.

In one embodiment, the first duct housing 136 may be coupled to the fan housing 108 in a fixed manner. The first duct housing 136 may be sized and configured to fit with an upper portion of the fan housing 108 such that the first duct housing 136 may be positioned above the fan housing 108 so as to facilitate the air flow from the base duct 126 and into and through the first duct housing 136. Further, as previously set forth, the first duct housing 136 may include a first air outlet 142 and a first misting outlet 144 such that the first air outlet 142 communicates with the air flow flowing from the base duct, as indicated by arrow 132, and the first misting outlet 144 communicates with the misting tube 120. Similarly, the second duct housing 138 may include a second air outlet 146 and a second misting outlet 148 such that the air flow may flow from the base duct 126 and through the second air outlet 146 and mist may flow from the misting tube 120 and through the second misting outlet 148. Likewise, the third duct housing 140 may include a third air outlet 150 and a third misting outlet 152 so that the air flow from the base duct 126 and exit the third air outlet 150 and the mist may flow from the misting tube 120 and from the third misting outlet 152.

The second duct housing 138 may be positioned above and coupled to an upper portion of the first duct housing 136 in a rotatable manner, discussed in further detail herein. Similarly, the third duct housing 140 may be positioned above and rotatably coupled to an upper portion of the second duct housing 138. In this manner, the first, second, and third duct housings 136, 138, 140 may be stacked and coupled to each other so as to provide an upward extending air duct 134 for the air flow from the fan 124 to disperse from the corresponding air outlets 102 of the multiple duct housings 7. Further, upper and lower ends of each of the duct housings 7 may define a circular periphery or structure so as to readily facilitate such multiple duct housings to be rotatably coupled together.

Furthermore, each of the duct housings 7 may include an outer housing portion 154 and an inner housing portion 156 so as to at least partially define the air outlet 102 for each of the duct housings 7. In one embodiment, at a front side 158 of each of the duct housings 7, the outer housing portion 154 may define an outer tubular portion 160 with a circular structure. Further, the inner housing portion 156 of each of the duct housings 7 may include a tubular structure 162 that may extend horizontally through at least a portion of each of the multiple duct housings 7. Such tubular structure 162 may define a rear open end 164 and a front open end 166 to define a through hole through each of the duct housings 7. With this arrangement, the air outlet 102 for each of the duct housings may be a ring shaped space/gap or opening defined between the circular ends of the tubular structure 162 and the outer tubular portion 160 on the front side 158 of the outer housing portion 154.

Figure 4:
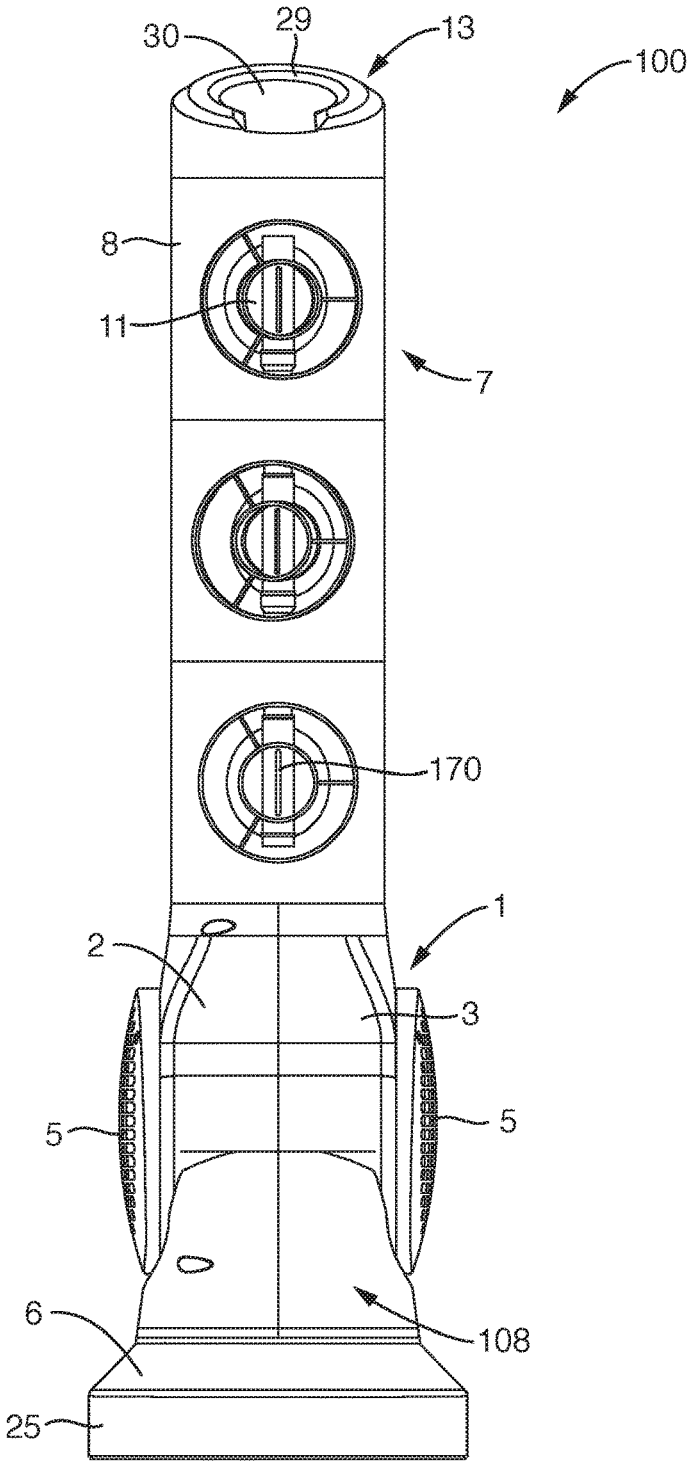
FIG. 4 is a front view of the cooling fan of FIG. 1, according to another embodiment of the present invention.
Figure 5:
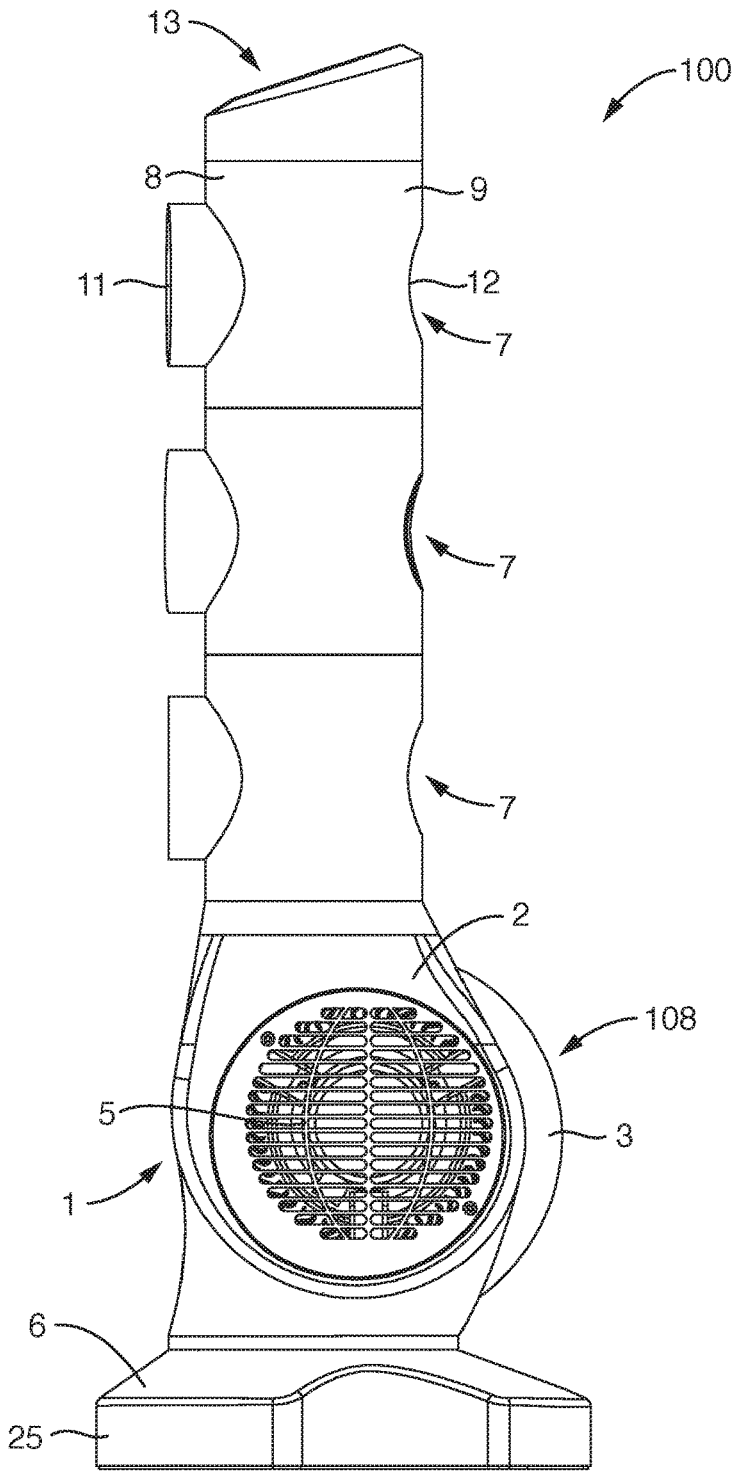
FIG. 5 is a side view of the cooling fan of FIG. 1, according to another embodiment of the present invention.

Further, each of the duct housings 7 may include a portion of the misting tube 120 extending along the longitudinal axis 104 of the cooling fan 100 so as to extend transversely through the tubular structure 162 of the inner housing portion 156. In one embodiment, the misting outlets 110 of the misting tube 120 may include tubular extensions 168 that extend from the misting tube 120 within the tubular structure 162 toward the front open end 166 so as to facilitate mist to be directed toward the front open end 166 of the tubular structure 162. In another embodiment, the misting outlet 110 may be in the form of an aperture 170, such as an elongated aperture (see FIG. 4), formed in the misting tube 120 disposed within the tubular structure 162 of the inner housing portion 156 sized and configured to provide mist therefrom. With this arrangement, as mist is directed through each of the misting outlets 110, the air flow from the air outlets 102 draws the mist outward, as indicated by arrow 172, from the respective misting outlets 110 to mix with the dispersed air to flow outward within the room that the cooling fan 100 is positioned. Such drawing of the mist is more readily facilitated with the rear open end 164 of the tubular structure 162 such that the strong air flow exiting the air outlets 102, shown by arrows 132, draws or pulls air through the tubular structure 162 from the rear open end 164 thereof toward the front open end 166 of the tubular structure 162, thereby, moving the mist and water droplets toward the corresponding air outlets 102 to mix with the dispersed air in the room.

In another embodiment, as previously set forth, each of the multiple duct housings 7 include a portion of the misting tube 120 extending vertically therein such that the misting tube 120 includes the misting outlets 110 corresponding with each of the multiple duct housings 7. As depicted in FIGS. 3 and 6, the misting tube 120 may include a lower misting tube portion 174 and multiple upper misting tube portions 176. The lower misting tube portion 174 may extend between the tank 25 and a lower most one of the upper misting tube portions 176. The lower misting tube portion 174 may be a flexible tube and may extend off-axis below the duct housings 7. Some of the upper misting tube portions 176 may be integrally formed with the tubular structure 162 of the inner housing of the duct housings and some may be separate tube pieces 28 that may be configured to be rotatably coupled between adjacent duct housings 7. The integrally formed and separately formed upper misting tube portions 176 may be rigid tubular structures. Each of the upper misting tube portions 176 may be sized and configured to be coupled together to extend longitudinally along the longitudinal axis 104 such that the upper misting tube portions collectively form a column that extends through each of the duct housings 7.

As previously set forth, the cooling fan 100 may also include a cover housing or top cover 13. Such top cover 13 may be sized and configured to couple to an upper portion of the upper most duct housing 7 or third duct housing 140 with a top cover base 14 therebetween. Further, the top cover 13 may include structure for coupling, for example, a circuit control board 31 therein with input controls associated therewith. In one embodiment, the input controls may be positioned along an upper surface of the top cover 13.

Figure 2A:
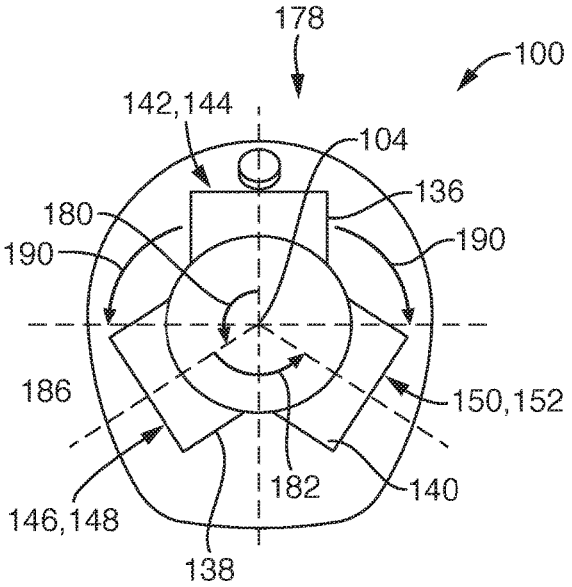
FIG. 2A is a simplistic top view of the cooling fan, depicting each of the multiple air outlets in off-set positions relative to each other, according to another embodiment of the present invention.

Now with reference to FIGS. 2 and 2A, as previously set forth, the first, second, and third duct housings 136, 138, 140 may be rotatably and positionably adjusted relative to each other so as to facilitate air flow and mist in various directions from the cooling fan 100. For example, the first duct housing 136 may be fixedly coupled to the fan housing 108 such that the first air outlet 142 remains positioned and aligned with a front side 178 of the cooling fan 100. The second duct housing 138 may be rotatably coupled to the first duct housing 136 such that the second duct housing 138 may be manually rotated about the longitudinal axis 104 relative to the first duct housing 136 such that the second air outlet 146 and second misting outlet 148 is positionable in a non-aligned manner relative to the first air outlet 142 and the first misting outlet 144. In one embodiment, the second duct housing 138 may be manually rotatable to any position clockwise or counter-clockwise of up to about 120 degrees relative to the fixed position of the first duct housing 136, thereby, providing a total range of rotation of up to about 240 degrees. As depicted in FIG. 2A, the second duct housing 138, at center, is positioned about 120 degrees counter-clockwise relative to the first duct housing 136, at center, as indicated by arrow 180. Similarly, the third duct housing 140 may be manually rotatable about the longitudinal axis 104 to any position clockwise or counter-clockwise of up to about 120 degrees relative to the position of the second duct housing 138, providing a total range of rotation of about 240 degrees. As depicted, the third duct housing 140, at center, is positioned about 120 degrees counter-clockwise relative to the position of the second duct housing 138, at center, as indicated by arrow 182. With the selected maximum rotated positions of the second and third duct housings 138, 140, the duct housings may be rotationally spaced equidistant relative to each other, i.e., about 120 degrees, which, depending upon the space or room the user desires to cool, may be a preferred position for the multiple duct housings 7. In this manner, a user may position the cooling fan 100 in a given room and provide a cooling effect with dispersed air and mist mixed together in multiple directions.

Figure 2B:
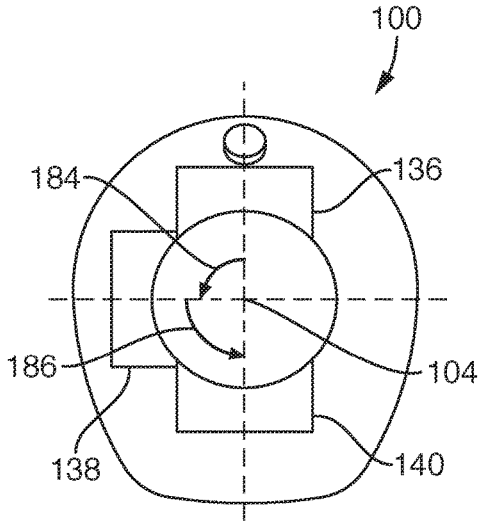
FIG. 2B is a simplistic top view of the cooling fan, depicting another embodiment of each of the multiple air outlets in off-set positions relative to each other, according to the present invention.
Figure 2C:
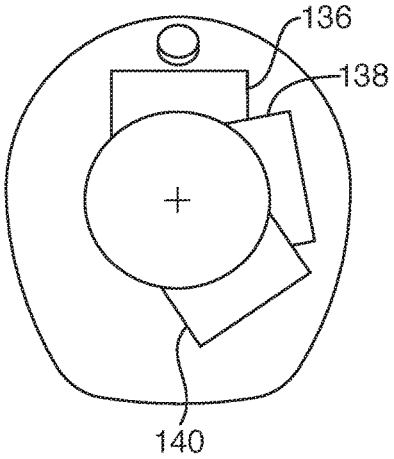
FIG. 2C is a simplistic top view of the cooling fan, depicting another embodiment of each of the multiple air outlets in off-set positions relative to each other, according to the present invention.

As depicted in FIG. 2B, in another embodiment similar to the previous embodiment of the cooling fan 100, the second and third duct housings 138, 140 may be manually rotatable about the longitudinal axis 104 to any position clockwise or counter-clockwise of up to about 90 degrees relative to the position of the adjacent lower duct housing. As such, in this embodiment, the total range of rotation of the second and third duct housings 138, 140 is up to about 180 degrees. As depicted, the second duct housing 138 is rotatably positioned 90 degrees counter-clockwise relative to the first duct housing 136, as indicated by arrow 184, and the third duct housing 140 is rotatably positioned 90 degrees counter-clockwise relative to the second duct housing 138, as indicated by arrow 186. As depicted in FIG. 2C, the second and third duct housings 138, 140 may be positioned randomly relative to each other and the first duct housing 136 as desired by the user. In this manner, as previously set forth, the second and third duct housings 138, 140 may be manually rotatable to any fixed position clockwise or counter-clockwise within its maximum range of rotation.

Furthermore, with reference again to FIGS. 2 and 2A, the fan housing 108 may oscillate or pivot back-and-forth about the longitudinal axis 104 relative to the base 106, as indicated with arrow 190. For example, such pivoting or oscillation may be fixed via the user input controls to span or range between about 10 degrees (or lower) and about 180 degrees, as desired by the user. In this manner, the oscillation range may be selected by a user to span, for example, a 90 degree range, a 120 degree range, or a 180 degree range, or any other selected range desired by the user. In another embodiment, the cooling fan 100 may include a single fixed oscillating range. In another embodiment, a user may turn off the oscillating function via the user input controls. In another embodiment, the oscillating function of the cooling fan 100 may be modified to change the speed by which the cooling fan moves back-and-forth over the selected range of oscillation. With this arrangement, the user may manually adjust the multiple duct housings 7 to a desired position relative to each other, as previously set forth, as well as select a desired oscillation range to maximize the cooling coverage of the cooling fan for a given room and placement of the cooling fan 100 in the room. In this manner, the combination of the multi-directional air outlets 102 and the oscillating function of the cooling fan 100, the cooling coverage and air dispersal can span over a 360 degree range.

Now with reference to FIGS. 3 through 7, the cooling fan 100 will now be described relative to its various components and the assembly thereof. The fan housing 108 may be in the form of a volute type structure 1 that may include a first volute portion 2 and a second volute portion 3. Such first and second volute portions 2, 3 may be joined with a snap type arrangement or other coupling mechanism. The volute structure 1 of the fan housing 108 may define oppositely positioned air inlet openings 4 or holes on left and right sides of the volute structure 1. Further, the air inlet openings 4 may be similarly sized and symmetrical relative to each other. Each of the air inlet openings 4 may include an air duct inlet grid 5 sized and configured to be coupled thereto. Upon coupling the first and second volute portions 2, 3 together, the fan housing 108 may be sized and configured to be coupled to an air duct base 6 at a bottom portion of the fan housing 108. An upper portion of the fan housing 108 may be coupled to the lower most one of the duct housings 7, or first duct housing 136 (FIG. 1), as previously set forth and described.

Each of the duct housings 7 may include a front air duct portion 8 and a back air duct portion 9, the front and back air duct portions 8, 9 may be sized and configured to couple together with a snap type fit or any other suitable coupling mechanism to, thereby, form each of the duct housings 7, as previously described. Further, adjacent duct housings 7, such as the first and second duct housing 136, 138 (FIG. 1), may be coupled together, as previously set forth, with a ring shaped member therebetween, such as a pad 10 or the like. Further, the top cover 13 may be assembled to the upper most one of the duct housings 7, such as the third duct housing, with a top cover base 13 positioned therebetween.

As previously set forth, the fan housing 108 may be assembled with the fan 124 or primary fan which may include the motor 15 and impeller 16. Further, a wind screen 17 may be positioned within the air duct 134 defined by the duct housings 7 below the top cover 13 and above an end of the misting tube 120 (FIG. 6).

Further, the structural components of the before described oscillating function of the cooling fan may include a gear cover 18, a gear 19, a steel ball seat 20, a rotating seat 21, and a gear ring 22 each sized and configured to be assembled and positioned between the impeller 16 and the air duct base 6. Further, a synchronous motor 23 and a rotating fixed plate 24 may be sized and configured to be assembled and positioned under the air duct base 6. The gear 19 may mesh or nest with the gear ring 22 such that the gear ring 22 may be positioned adjacent to or under the rotating seat 21. The rotating seat 21 may be rotatably coupled to fixed plate 24. Further, the rotating seat 21 may be sized and configured to be positioned and assembled over the air duct base 6. With this arrangement, the structural components set forth above may be employed for implementing the oscillating function of the cooling fan 100 with any other structural and electrical components needed as known to one of ordinary skill in the art.

Furthermore, the cooling fan, as previously set forth, includes a misting function for generating and delivering mist to mix with the dispersed air. Such misting function includes a base defining the tank 25, the axial flow fan 26, the atomizer 27 and the misting tube 120. As previously set forth, the misting tube 120 includes a lower misting tube portion 174 and multiple upper misting tube portions 176, including two separate tube pieces 28 of the upper misting tube portions 176 coupling the upper misting tube portions 176 integrally formed in the duct housings 7. At the base 106 of the cooling fan 100, the tank 25 may be installed under the air duct base 6. The atomizer 27 and axial flow fan 26 may be coupled to a bottom of the tank 25, as known to one of ordinary skill in the art, such that the axial flow fan 26 may be positioned below the atomizer 27 to direct the mist through the misting tube 120. The misting tube 120 may be coupled to or positioned above a top portion of the atomizer 27 such that the misting tube 120 may extend through the air duct 134 along the longitudinal axis 104 of the cooling fan 100 to disperse mist from the cooling fan 100, as previously set forth.

In one embodiment, the atomizer 27 may be sized and configured to produce a vibration generated by ultrasonic frequency. At certain ultrasonic frequencies, the atomizer 27 may be sized and configured to generate the before discussed mist. In one embodiment, the atomizer 27 may vibrate to generate water droplet sizes that provide an optimal cooling effect, the ultrasonic frequency to produce optimal vibration and, thus, optimal droplet size may be in the range of 1.0 to 1.7 megahertz (MHz). In other embodiments, other ultrasonic frequencies may be applied with the mistorizing device 24 that may be in the range of 1.0 to 1.3 MHz, 1.0 to 1.4 MHz, 1.0 to 1.5 MHz, or 1.0 to 1.6 MHz, in order to achieve the optimal droplet size for manipulating the humidity and moisture content dispersed from the cooling fan 100 and into a given room.

Furthermore, the top cover 13 may include a top cover ornamental portion 29 positioned over an outer surface of a key board plate 30 such that the top cover 13 may be coupled to the top cover base 14 to define a cavity therebetween. Within this cavity, a circuit control board 31 may be positioned. Such circuit control board 31 may be electrically coupled to the keyboard plate 29 so as to facilitate user input controls to control and activate various functions of the cooling fan 100. For example, the circuit control board 31 may be electrically connected to the fan 124, the oscillation function, and the misting function of the cooling fan 100 so that a user may employ the cooling fan 100 as desired. In this manner, the cooling fan 100 may be employed to implement various desired functions, such as misting amount, fan speed, and oscillation span, as well as other functions. Further, the user may manually select the region or area within a room for cooling with the rotational duct housings 7 to control the direction or region for dispersing and supplying air flow within a given room relative to the placement of the cooling fan 100.

With reference to FIGS. 8-13, various views of another embodiment of a cooling fan 200 are provided. This embodiment may include similar design and structure (as depicted in FIG. 1) and functions as described in the previous embodiment of the cooling fan 100, except in this embodiment, the cooling fan may include a handle 202. The handle 202 may be in the form of a cavity 204 defined in a rear side 206 of a top cover 208, the top cover 208 coupled to an upper portion of multiple duct housings 210, as in the previous embodiment. With this arrangement, the cooling fan 200 having the handle 202 may readily facilitate the portability of the cooling fan.

While the invention may be susceptible to various modifications and alternative forms, specific embodiments have been shown by way of example in the drawings and have been described in detail herein. Further, the structural features of any one embodiment disclosed herein may be combined or replaced by any one of the structural features of another embodiment set forth herein. As such, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A cooling fan extending vertically to define a longitudinal axis, the cooling fan configured to blow air and mist therefrom, the cooling fan comprising:

a base including a tank sized and configured to hold water, the tank including a misting tube, an atomizer, and an axial flow fan associated therewith;

a fan housing rotatably coupled to the base, the fan housing defining an air inlet therein and including a fan coupled to the fan housing, the fan housing defining a base duct adjacent to the fan configured to facilitate upward air flow;

a first duct housing coupled to the fan housing so as to facilitate the air flow from the base duct, the first duct housing positioned above the fan housing and including a first air outlet and a first misting outlet, the first air outlet communicating with the air flow flowing from the base duct, the first misting outlet communicating with the misting tube;

a second duct housing rotatably coupled to the first duct housing so as to facilitate the air flow from the first duct housing, the second duct housing positioned above the first duct housing and including a second air outlet and a second misting outlet, the second air outlet communicating with the air flow flowing from the base duct, the second misting outlet communicating with the misting tube;

a third duct housing rotatably coupled to the second duct housing so as to facilitate the air flow from the second duct housing, the third duct housing positioned above the second duct housing and including a third air outlet and a third misting outlet, the third air outlet communicating with the air flow flowing from the base duct, the third misting outlet communicating with the misting tube; and a cover housing coupled to an upper portion of the third duct housing, the cover housing including a circuit control board coupled thereto with input controls associated therewith.

2. The cooling fan of claim 1, wherein the fan housing with each of the first, second and third duct housings coupled thereto is configured to oscillate about the longitudinal axis relative to the base.

3. The cooling fan of claim 1, wherein the fan housing is configured to oscillate about the longitudinal axis relative to the base with a range of oscillation between about 30 degrees and about 180 degrees.

4. The cooling fan of claim 1, wherein the second duct housing is rotatable about the longitudinal axis relative to the first duct housing such that the second air outlet and second misting outlet is positionable in a non-aligned manner relative to the first air outlet and the first misting outlet.

5. The cooling fan of claim 1, wherein the second duct housing is rotatable about the longitudinal axis relative to the first duct housing with a range of rotation of up to about 240 degrees.

6. The cooling fan of claim 1, wherein the third duct housing is rotatable about the longitudinal axis relative to the second duct housing with a range of rotation of up to about 240 degrees.

7. The cooling fan of claim 1, wherein the misting tube comprises a lower misting tube and multiple upper misting tubes, the lower misting tube extending between the water tank and a lower most one of the upper misting tubes, each of the upper misting tubes coupled together and extending longitudinally along the longitudinal axis such that the upper misting tubes collectively form a column that extends through the first, second and third duct housings.

8. The cooling fan of claim 1, wherein air flow from the first, second, and third air outlets draws mist outward from the respective first, second, and third misting outlets to mix therewith and disperse outward.

9. The cooling fan of claim 1, wherein the atomizer is configured to produce ultrasonic frequencies to generate the mist, the ultrasonic frequencies produced by the atomizer are in the range of 1.0 MHz to 1.7 MHz.

10. A cooling fan extending vertically to define a longitudinal axis, the cooling fan configured to blow air and mist therefrom, the cooling fan comprising:

a base including a tank sized and configured to hold water, the tank including a misting tube, an atomizer, and an axial flow fan associated therewith, the atomizer configured to generate the mist such that the axial flow fan directs the mist upward through the misting tube;

a fan housing rotatably coupled to the base, the fan housing defining an air inlet therein and including a fan coupled to the fan housing, the fan housing defining a base duct adjacent to the fan configured to facilitate upward air flow;

multiple duct housings coupled in an upward stacked arrangement to form an air duct communicating with the base duct, each of the multiple duct housings including an air outlet and a misting outlet, the air outlet communicating with the air flow from the base duct and the misting outlet communicating with the misting tube;

wherein each one of the multiple duct housings is rotatable about the longitudinal axis relative to an adjacent one of the multiple duct housings in the range of up to about 240 degrees.

11. The cooling fan of claim 10, wherein the air flow dispersing from the air outlet of each of the multiple duct housings is configured to draw mist outward from the misting outlet of each of the multiple duct housings to mix therewith and disperse outward from the multiple duct housings.

12. The cooling fan of claim 10, wherein each of the multiple duct housings define an outer housing portion and an inner housing portion, the inner housing portion having a tubular shape extending horizontally to define a rear side opening and a front side opening to define a through hole.

13. The cooling fan of claim 10, wherein each of the multiple duct housings define an outer housing portion and an inner housing portion, the air outlet defined between the outer housing portion and the inner housing portion on a front side of each of the multiple duct housings.

14. The cooling fan of claim 10, wherein each of the multiple duct housings include the misting tube extending vertically therein, the misting tube including the misting outlets corresponding with each of the multiple duct housings.

15. The cooling fan of claim 10, wherein the misting tube comprises a lower misting tube and multiple upper misting tubes, the lower misting tube extending between the water tank and a lower most one of the upper misting tubes, each of the upper misting tubes coupled together and extending longitudinally along the longitudinal axis such that the upper misting tubes collectively form a column that extends through the multiple duct housings, the column of the upper misting tubes having transversely extending misting extensions corresponding with each of the multiple duct housings, the misting extensions configured to funnel the mist toward the misting outlet.

16. The cooling fan of claim 10, wherein the atomizer is configured to produce ultrasonic frequencies to generate the mist, the ultrasonic frequencies produced by the atomizer are in the range of 1.0 MHz to 1.7 MHz.

* * * * *